US006058851A

United States Patent [19]

Alexander et al.

[11] Patent Number: 6,058,851

[45] Date of Patent: May 9, 2000

[54] RIM TOP TABLE

[75] Inventors: Brian D.T. Alexander, Holland; Jeffrey J. Reuschel, Hamilton; Steven J. Beukema, Grand Rapids, all of Mich.

[73] Assignee: Haworth, Inc., Holland, Mich.

[21] Appl. No.: 08/983,619

[22] PCT Filed: Jun. 5, 1997

[86] PCT No.: PCT/US97/10701

§ 371 Date: Dec. 31, 1997

§ 102(e) Date: Dec. 31, 1997

[87] PCT Pub. No.: WO97/46141

PCT Pub. Date: Dec. 11, 1997

Related U.S. Application Data

[60] Provisional application No. 60/019,407, Jun. 7, 1996.

[51] Int. Cl.[7] ..... A47B 85/00

[52] U.S. Cl. ..... 108/25; 108/50.01

[58] Field of Search ..... 108/25, 26, 26.2, 108/24, 27, 50.01, 50.02, 51.11, 161

[56] References Cited

U.S. PATENT DOCUMENTS

| | | | |
|---|---|---|---|
| 441,913 | 12/1890 | Wiesbauer | 108/26 X |
| 506,530 | 10/1893 | McGrady | 108/26 |
| 512,665 | 1/1894 | Russell | 108/26 X |
| 581,127 | 4/1897 | McCorkle . | |
| 1,528,855 | 3/1925 | Smith . | |
| 1,911,959 | 5/1933 | Kern et al. . | |
| 2,090,176 | 8/1937 | Besancon . | |
| 2,676,863 | 4/1954 | Cooper | 108/26 X |
| 2,935,209 | 5/1960 | Fritz | 108/25 |
| 3,759,569 | 9/1973 | Bennet | 108/25 X |
| 3,899,982 | 8/1975 | Fetzek | 108/25 |
| 4,510,872 | 4/1985 | Parry | 108/25 |
| 4,802,595 | 2/1989 | Northington | 108/26 X |
| 5,118,004 | 6/1992 | Carilli | 108/24 |
| 5,120,117 | 6/1992 | Williams . | |
| 5,317,977 | 6/1994 | Omessi . | |

FOREIGN PATENT DOCUMENTS

| | | |
|---|---|---|
| 1 221 737 | 6/1960 | France . |

*Primary Examiner*—Jose V. Chen
*Attorney, Agent, or Firm*—Flynn, Thiel, Boutell & Tanis, P.C.

[57] ABSTRACT

A table top provided with a paper-organizing and storing structure fixedly positioned along an edge of the table top. The structure includes a wall which extends along but is spaced slightly outwardly from the edge of the table top. The wall in cooperation with the adjacent edge defines a downwardly opening pocket recess which in a preferred embodiment is sloped to project partially under the table top. This pocket enables papers to be inserted downwardly into the pocket through an upper open mouth thereof. The depth of the pocket causes upper portion of the paper to bear against the free edge of the wall and project upwardly a small extent above the upper top surface, whereby the user can readily access and visually inspect at least the upper portion of the paper while it is stored in the pocket.

13 Claims, 4 Drawing Sheets

RIM TOP TABLE

This appln claims the benefit of prov. appln. Ser. No. 60/019,407 filed Jun. 7, 1996.

FIELD OF THE INVENTION

This invention relates to a table top of the type used in offices and the like, and specifically relates to an improved table top provided with a rim structure extending along one or more edges thereof and defining a recess or pocket for accommodating papers and the like to allow organization and viewing thereof without requiring that they be positioned or stacked directly on the upper surface of the table top.

BACKGROUND OF THE INVENTION

The modern office work surface, such as a table top, is typically extensively utilized for supporting papers and related office equipment. A worker, when working at a table top, will typically have numerous papers positioned at various locations on the table top, often in various stacks. Control and organization of the papers, and efficient use and access thereto, is difficult to achieve. There is thus a need to provide either increased surface or more desirably to provide increased user efficiency with respect to the available surface area of a table top or work surface.

It is an object of this invention to provide improved paper handling structure associated with a work surface, such as a table top, to permit a user to more readily store papers on or in conjunction with the table top in a manner which provides organizational capability, visibility, and accessibility to such papers.

The present invention relates to an improved work surface and more specifically a table top provided with a paper-organizing and storing structure associated with and extending along one or more edges of the table top. This structure is fixedly positioned along an edge of the table top, and includes a wall structure which extends generally along but spaced slightly outwardly from the edge of the table top. The wall structure in cooperation with the adjacent edge defines a downwardly opening pocket or recess which in a preferred embodiment is also at least slightly sloped so as to project partially under the table top. This pocket enables the user to insert various papers therein merely by inserting them downwardly into the pocket through the upper open mouth thereof. The depth of the pocket is selected so that the papers have a length greater than the pocket depth, whereby an upper portion of the paper will bear against the free edge of the wall and project upwardly a small extent above the worksurface, whereby the user can readily access and also visually inspect at least the upper portion of the paper while it is stored in the pocket. Several such papers can be disposed in the pocket in spaced relation therealong so that the user can organize and yet also readily inspect and access numerous papers.

In an embodiment of the invention, the table top has a front generally concave edge which is positioned closest to the user, and a rear convex edge which is arcuately curved so that the user, when positioned adjacent the front concave edge, can readily and conveniently reach anywhere along the rear convex edge. The paper storage and organizing structure is preferably secured to the table so as to extend along the rear edge.

Other objects and purposes of the invention will be apparent upon reading the following specification and inspecting the accompanying drawings.

Figure 1:
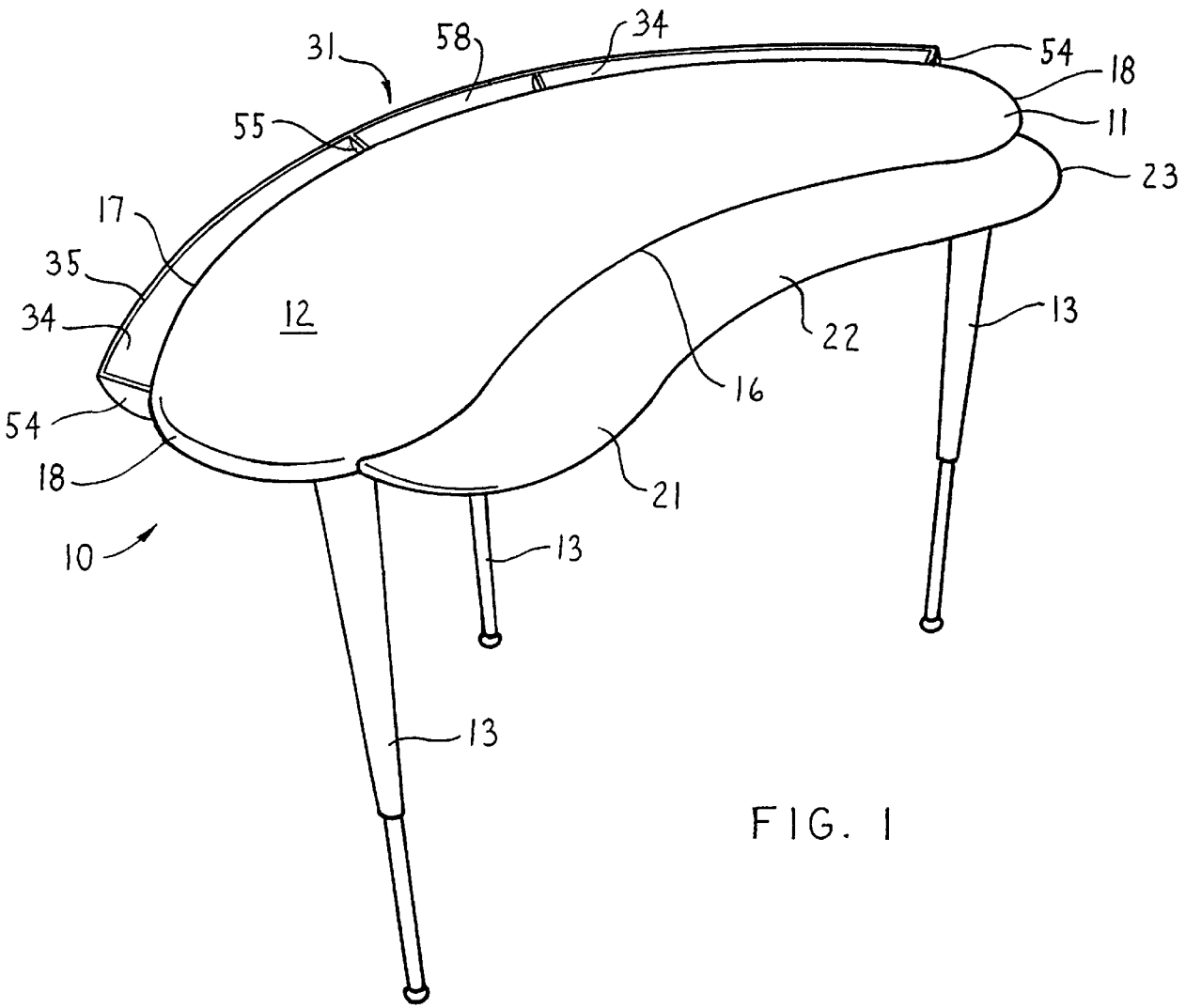
FIG. 1 is a perspective view of a table incorporating thereon a paper storage rim structure according to the present invention.

Certain terminology will be used in the following description for convenience in reference only, and will not be limiting. For example, the words "upwardly", "downwardly", "leftwardly" and "rightwardly" will refer to directions in the drawings to which reference is made. The word "forwardly" will be used in conjunction with the edge or portion of the table which is positioned closest to the user, and similarly the word "rearwardly" will refer to the edge or portion of the table which is typically positioned remote from the user. The words "inwardly" and "outwardly" will refer to directions toward and away from, respectively, the geometric center of the table and designated parts thereof. Said terminology will include the words specifically mentioned, derivatives thereof, and words of similar import.

DETAILED DESCRIPTION

FIG. 1 illustrates a freestanding table 10 of a type typically used in offices and the like. This table 10 includes a table top or worksurface 11 defining thereon a generally horizontal and planar upper working surface 12. The table top 11 in the illustrated embodiment is supported on a plurality, here three, of upright legs 13 adapted for supportive engagement with a floor.

The table top 11 in the illustrated embodiment is somewhat banana-shaped in that it includes an elongate and generally gradually curved concave front edge 16, an elongate and gradually curved convex rear edge 17, and generally rounded or curved convex end edges 18 which join between the front and rear edges 16 and 17.

The table top 11 is also provided with an armrest support 21 which is elongated and is fixed to the top 11 and extends generally along the front edge 16 thereof. This armrest support 21 projects outwardly a small distance from the edge 16 and itself defines thereon a front edge 22 which is of a gradually curved concave configuration similar to that of the edge 16 so that the edges 22 and 16 are approximately parallel with one another. The opposite ends of the arm support 21 are provided with exterior rounded convex end edges 23 which join to the front edge 22 and project rearwardly for connection with the edge 16 adjacent the opposite ends thereof.

The arm support 21 is preferably constructed of a material having at least limited cushioning or elasticity, such as a dense but somewhat compressible elastomeric material, to provide increased comfort to the user with respect to the positioning or resting of arms thereon during use of the table.

The arm support 21 in effect constitutes an extension and hence a structural part of the table top 11, and accordingly reference hereinafter to the table top 11 will refer also to the arm support 21 provided that same is associated with the table. Reference to the front edge of the table, namely the user-adjacent edge, will also refer to the edge which defines the overall front edge of the table top, this being the edge 22 in the illustrated embodiment.

Figure 4:
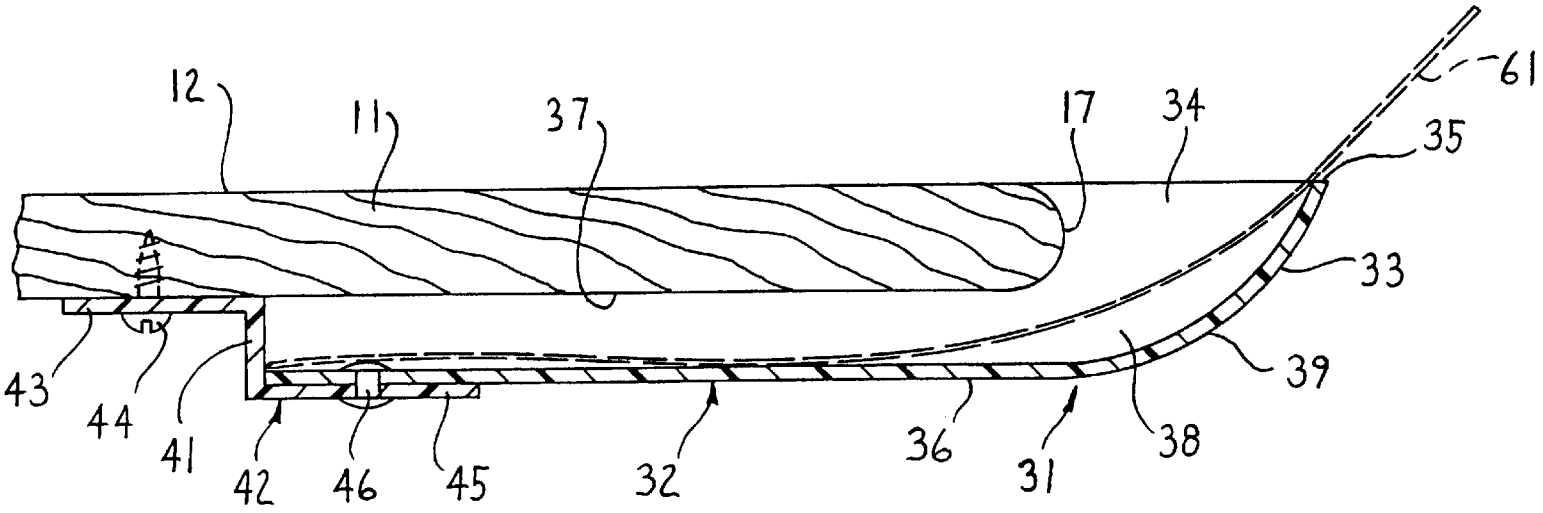
FIGS. 4 and 5 are enlarged sectional views taken along lines 4—4 and 5—5, respectively, in FIG. 3.
Figure 5:
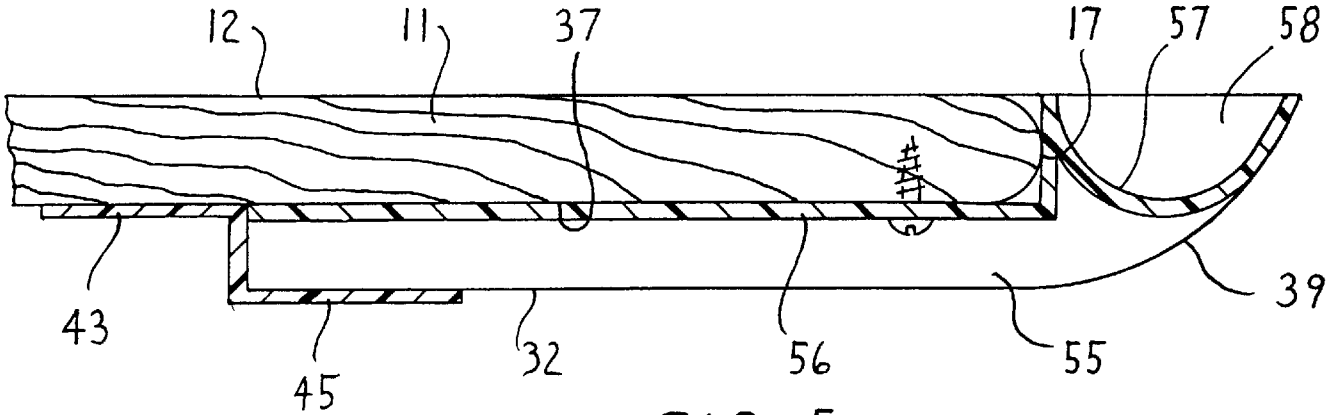

According to the present invention, the table 10 is provided with a paper handling structure 31 fixed to the table and extending along one or more of the edges thereof. This paper handling structure 31 in the illustrated and preferred embodiment is disposed adjacent and extends longitudinally along most of the length of the rear edge 17 of the table top. The paper handling structure 31 includes a main support wall 32 (FIG. 4) which includes an outer but generally upwardly projecting wall or rim part 33 which is positioned adjacent but spaced rearwardly from the rear edge 17. This rim part 33 is elongated horizontally so as to extend generally in parallel but rearwardly spaced relation from the rear edge 17, whereby there is defined a generally horizontally elongated but upwardly projecting opening or slot 34 therebetween. In the embodiment as illustrated by FIG. 4, this rim part 33 terminates in an upper free edge 35 which is approximately within the horizontal plane defined by the upper surface 12, although it will be appreciated that the position of this upper edge 35 can be slightly varied relative to the plane of the upper surface 12. In fact, in some situations it may be desirable to extend the rim part 33 upwardly at least a small distance above the upper surface 12, depending upon the nature of the papers and objects being supported by the paper handling structure 31.

The structural wall 32 also includes, in the illustrated embodiment, a bottom wall 36 which is joined to the rim part 33 and which projects inwardly under the table top 11 in downwardly spaced relation from the undersurface 37 thereof so as to define therebetween a storage recess or pocket 38. This storage pocket 38 opens upwardly through the slot or opening 34 defined adjacent the rear edge 17. The rim part 33 and bottom wall 36 are preferably smoothly joined together through an arcuate or smoothly curved transitional wall 39 so as to provide a smooth inner surface to facilitate the insertion of papers into the pocket 38.

The inner end of the pocket 38 is preferably closed off by a wall 41 which can effectively function as a stop to thus limit the extent to which papers can be inserted into the pocket 38. This stop wall 41 in the illustrated embodiment is part of a generally Z-shaped securing bracket 42, the latter having a top leg 43 which underlies and is suitably secured to the top 11, as by screws or fasteners 44. Bracket 42 also has a bottom leg 45 which underlies the inner free end of the bottom wall 36 and is suitably fixed thereto, such as by fasteners 46.

Figure 2:
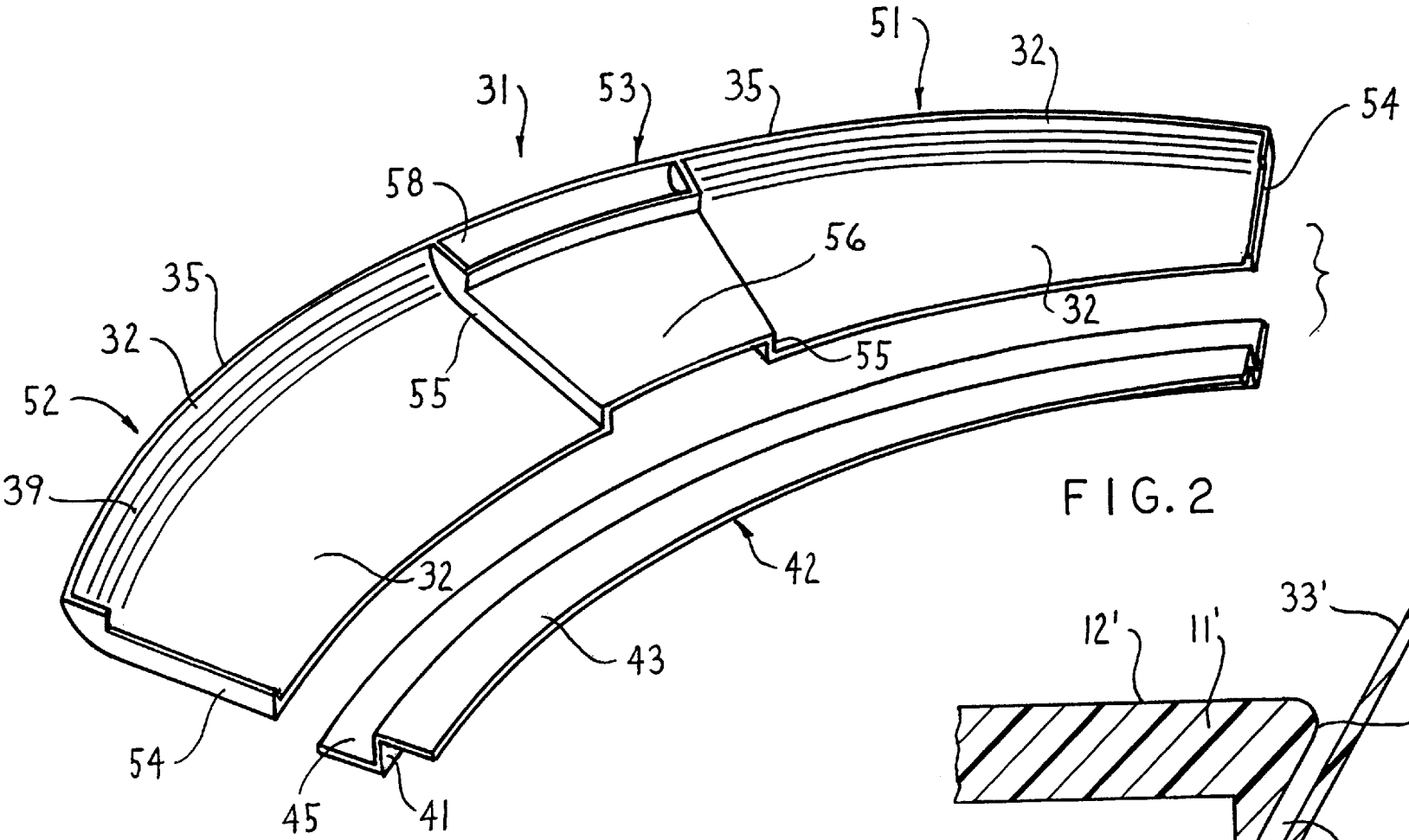
FIG. 2 is a perspective view of solely the paper-storing rim structure.
Figure 3:
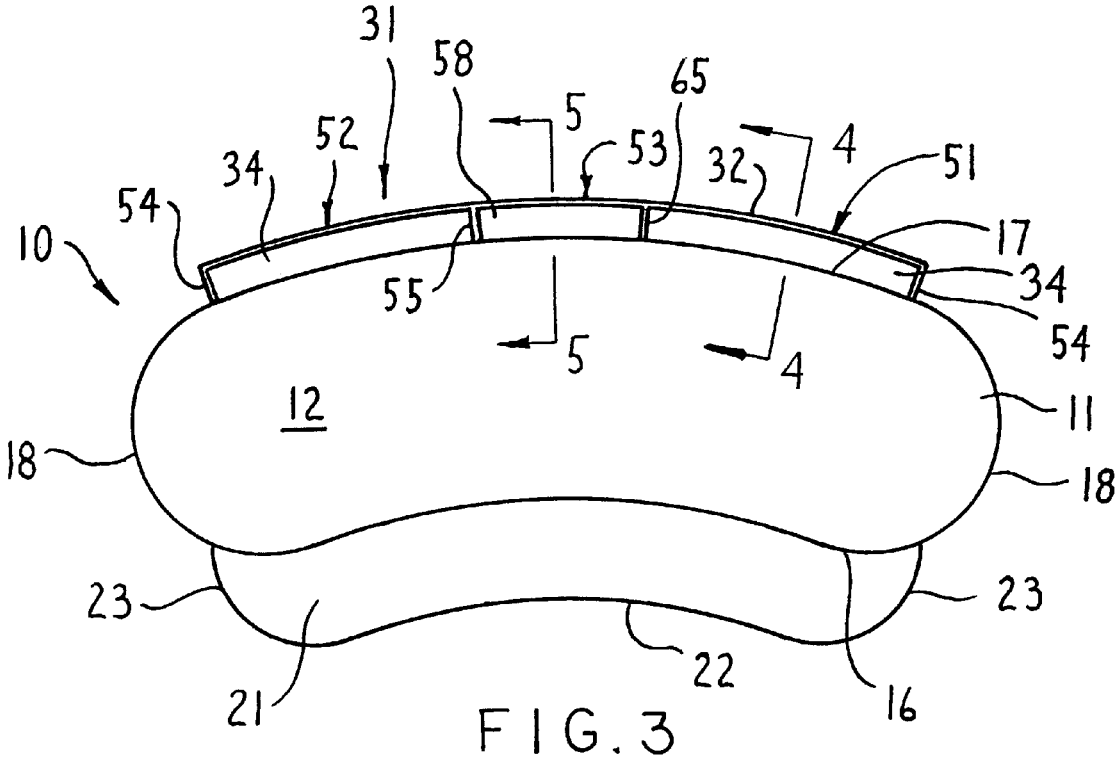
FIG. 3 is a top view of the table shown in FIG. 1.

The paper handling structure 31, as illustrated by FIGS. 1–3, includes two arcuately elongate sections 51 and 52 which are structurally and functionally identical but are separated by an intermediate center portion 53. These elongate portions 51 and 52 are each of a construction identical to that illustrated by FIG. 4, and each of these arcuate sections 51 and 52 are closed at opposite sides thereof by edge walls 54 and 55, the latter projecting upwardly from the bottom wall 36 so as to prevent papers from sliding sidewardly out of the respective pocket 38.

As to the center portion 53 of the paper handling structure 31, it is of generally short extent longitudinally along the table edge, and in the illustrated embodiment is preferably positioned close to the middle of the rear edge of the table top. This center section 53 includes a support wall 56 which is positioned upwardly relative to the bottom walls 32 and is integrally and structurally joined between the adjacent side walls 55. This support wall 56 directly underlies the table top 11 and is structurally joined thereto by fasteners, such as screws, to further assist in securement of the structure 31 to the table top.

The center sector 53, adjacent the outer edge thereof, preferably defines a generally upwardly-opening channel-like wall or trough 57 which has an outer free edge which is continuous and coextensively integral with the rear rim part 33. This channel or trough 57 defines a shallow upwardly opening pocket 58 adjacent the rear edge of the table top, which pocket 58 can be used to define a pencil tray or the like. This pocket can be further subdivided into additional small pockets along the longitudinal length thereof if desired so as to provide additional compartments for paper clips, etc.

In the illustrated and preferred embodiment, particularly as shown in FIG. 2, the sectors 51, 52, and 53 of the structure 31 are formed primarily by a single elongate member which can be suitably formed of a plastic material, which single member in conjunction with the securing bracket 42 define the entirety of the paper handling arrangement and permit easy and efficient mounting thereof on the table top. While the bracket 42 is also illustrated as a single elongate member preferably formed of a plastic material, it will be appreciated that the bracket 42 can be defined by two or more members, and in fact could assume many other configurations, while still providing the desired structure and function.

It will also be appreciated that the center section 53 is provided merely to illustrate a variation of a structure 31. Such center structure 53 can be eliminated, if desired, and in such case the paper defining pocket will extend in a continuous and uninterrupted manner along the rear edge of the table.

In use, the user will normally be seated close to the middle of the front edge 22 of the table. Due to the arcuate curvatures of the edges 18 and 22, the rear edge 18 is approximately equally accessible to the user along substantially the entirety of the length thereof. The paper handling structure 31 also extends longitudinally along the rear edge 18 and is likewise substantially equally and conveniently accessible, throughout its length, to a user positioned or seated adjacent the front edge 22.

The user can readily utilize the paper handling structure 31 for storing and organizing papers by inserting a paper, such as indicated by dotted lines at 61 in FIG. 4, downwardly through the opening 34 into the pocket 38. During the downward insertion, the smooth inner curved wall of the pocket as defined by the transition wall 39 assists the paper in deflecting as necessary so as to permit its slidable insertion into the pocket. The depth of the pocket 39, as limited by the stop wall 41, is selected so that the depth is less than the length of the paper 61, whereupon the paper 61 will thus project upwardly so that an upper portion thereof will effectively bear against the free edge 35 of the rear rim, with this upper portion of the paper also projecting upwardly at least a limited extent above the rear rim and hence above the upper surface of the table. A user seated or standing adjacent the front edge of the table will thus have continuous visibility of an upper portion of the stored papers, as well as ready access thereto, to facilitate the user with respect to his use of the table, and his storage and accessing of papers. Due to the elongate length of the pocket 38, namely the fact that this pocket extends along at least a majority of the rear edge 17, this enables a significant number of different papers, or stacks of papers, to be slidably inserted into and stored within the pocket 38 in sidewardly adjacent, or partial sidewardly overlapping relationship, to thus provide the user with visibility and access to a significant number of different papers without requiring that the papers be stacked directly on top of one another. The ability to store papers in this fashion, and yet provide visibility to at least upper portions of a significant number of papers, enables the papers to be organized in specific desired sequences as they are positioned in side by side relationship lengthwise along the pocket, and in fact the user can also readily reorganize and rearrange the sequence of papers depending upon the user's work needs.

Figure 6:
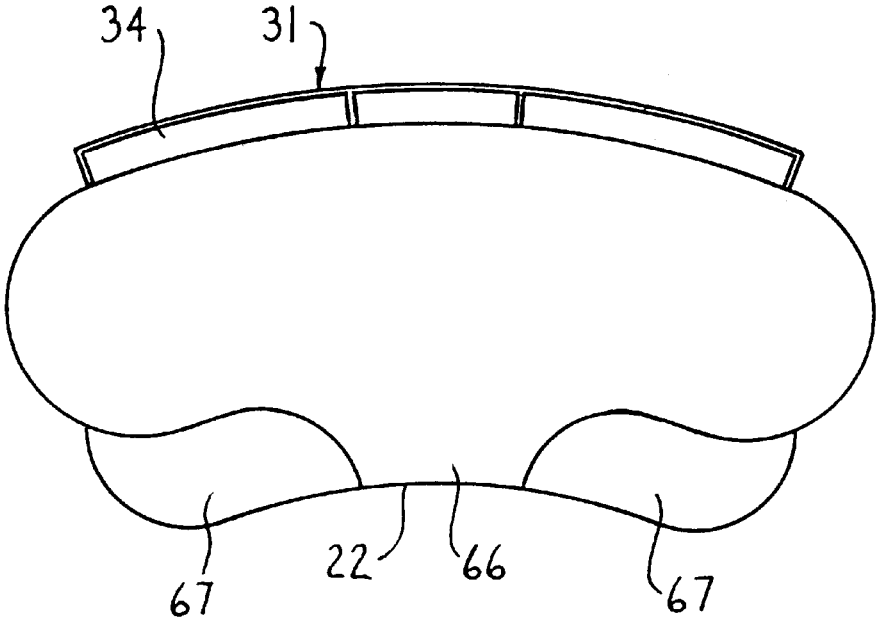
FIG. 6 is a top view similar to FIG. 3 but illustrating a variation in the structure of the table top.

Referring to FIG. 6, there is illustrated a variation. As is apparent from comparison of FIGS. 3 and 6, the variation of FIG. 6 merely involves providing the table top 11 with a front central extension 66, and in this case the elastomeric arm support is defined by two side parts 67 which again provide limited elastomeric cushioning for the arms on opposite sides of the rigid center projection 66. These parts 66 and 67 still define the front edge 22 of the table top.

The paper handling arrangement 31 of this invention thus greatly increases the useability of the table top without creating any significant increase in the overall size of the table, without detracting from the ornamentality or appearance of the table, and increases the useability of the upper working surface by permitting storing and organizing of papers close to and directly adjacent the table top without requiring that the papers be positioned directly on the upper surface 12.

Figure 7:
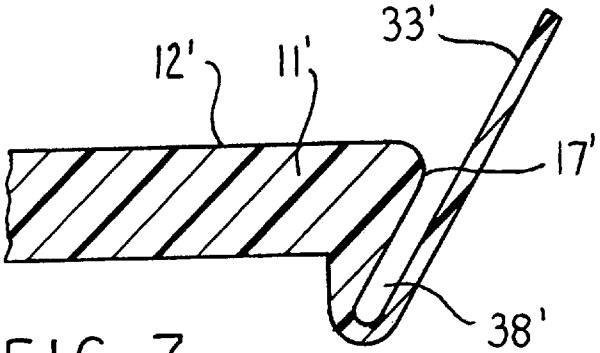
FIG. 7 is a cross-sectional view similar to FIG. 4 but illustrating a variation of the invention.

It will be appreciated that the paper handling arrangement of this invention is readily adaptable to a wide range of table tops and worksurfaces, irrespective of the size, shape and/or configuration thereof. The configuration of the paper handling structure itself may also vary significantly from that illustrated by the drawings, and in fact the structure may include a rim or wall part which projects upwardly a substantial distance above the upper working surface, and the pocket itself may project downwardly at a position more closely adjacent the rear edge of the top so as to be more vertically oriented, rather than projecting horizontally under the top as in the preferred embodiment illustrated by the above-described drawings. In this regard, reference is made to FIG. 7 wherein there is illustrated a cross-sectional view similar to FIG. 4 but illustrating a variation wherein the rim part 33' does project upwardly above the upper surface 12' of the table top 11' and the pocket 38' slopes downwardly with a more pronounced vertical orientation directly adjacent the rear edge 17'. In the variation illustrated by FIG. 7, a greater fractional part of the stored papers may be positioned for visibility, although such variation of the invention also conflicts with overall useability of the table top under some use conditions due to the upward protrusion of the rim part 33'.

Although a particular preferred embodiment of the invention has been disclosed in detail for illustrative purposes, it will be recognized that variations or modifications of the disclosed apparatus, including the rearrangement of parts, lie within the scope of the present invention.

We claim:

1. In a table top having a generally horizontally enlarged upper working surface defined by a plurality of edges, the improvement comprising a paper handling structure fixed to said table top and extending longitudinally along at least one of said edges for permitting storage of papers therein in at least a partially upright manner adjacent said one edge, said paper handling structure including a wall structure which cooperates with said table top for defining a paper-receiving pocket which projects downwardly from said upper working surface adjacent said one edge and then horizontally inwardly so as to project under said table top, said wall structure including an upper rim part which is disposed adjacent but spaced away from said one edge for defining an access opening into said paper-receiving pocket for permitting insertion of papers thereinto, said upper rim part projecting upwardly so as to substantially intersect a generally horizontal plane defined by said upper working surface and terminating at an upper free edge, said paper handling structure further including a securing structure fixedly connecting a portion of said wall structure to said table top such that no part of said paper handling structure overlies said upper working surface.

2. A table top according to claim 1, further comprising an upwardly opening trough defining a further shallow pocket, said trough being disposed between said one edge and said upper rim and being generally aligned with said paper-receiving pocket.

3. A table top according to claim 2, in which said trough is subdivided into a plurality of small pockets.

4. A table top according to claim 1, wherein said portion of said wall structure is a bottom wall joined to said upper rim part and extending inwardly under said table top and spaced downwardly therefrom to define said pocket therebetween, said securing structure including a bracket disposed to connect said bottom wall at an inner free end thereof to a bottom surface of said table top such that said bracket is not visible from an area adjacent said upper working surface, said bracket having a stop wall defining a portion of said paper-receiving pocket and being disposed to limit the extent to which papers can be inserted into said paper-receiving pocket.

5. A table top according to claim 1, wherein said wall structure has at least two said paper-receiving pockets positioned longitudinally along said one edge, and an upwardly opening trough defining a further shallow pocket, said trough being disposed between said one edge and said upper rim and aligned longitudinally between said two paper-receiving pockets.

6. A table top according to claim 1, wherein said access opening is defined on one side solely by said one edge and on an opposite side by said upper rim part.

7. In a table top having a horizontal upper working surface defined by a plurality of edges, the improvement comprising a wall structure fixed to said table top and extending longitudinally along at least one of said edges for permitting storage of papers therein in at least a partially upright manner adjacent said one edge, said wall structure having an elongated main wall and a plurality of edge walls cooperating to define a downwardly opening paper-receiving pocket adjacent to and extending longitudinally along said one edge, said paper-receiving pocket having a generally L-shaped cross-section, said main wall including a bottom wall joined to an upper rim part by a transitional wall which is arcuate in cross-section and joins said upper rim part to said bottom wall in a gradually curving manner, said upper rim part being disposed adjacent but spaced away from said one edge for defining an access opening into said paper-receiving pocket for permitting insertion of papers therein.

8. A table top according to claim 7, wherein said paper-receiving pocket projects downwardly from said upper working surface adjacent said one edge and also projects inwardly so as to partially project under said table top.

9. A table top according to claim 7, further comprising an upwardly opening trough defining a further shallow pocket, said trough being disposed between said one edge and said upper rim part and aligned with said paper-receiving pocket.

10. A table top according to claim 9, in which said trough is subdivided into a plurality of small pockets.

11. A table top according to claim 7, wherein said bottom wall extends inwardly under said table top and is spaced downwardly therefrom to define said pocket therebetween, said paper handling structure including a securing bracket interconnecting said bottom wall at an inner free end thereof and a bottom surface of said table top such that said securing bracket is not visible from an area adjacent said upper work surface, said securing bracket having a stop wall defining a portion of said paper-receiving pocket and being disposed to limit the extent to which papers can be inserted into said paper-receiving pocket.

12. A table top according to claim 7, wherein said wall structure has at least two said paper-receiving pockets positioned longitudinally along said one edge, and an upwardly opening trough defining a further shallow pocket, said trough being disposed between said one edge and said upper rim and aligned longitudinally between said two paper-receiving pockets.

13. A table top according to claim 7, wherein said access opening is defined on one side solely by said one edge and on an opposite side by said upper rim part.

* * * * *